US011846206B2

(12) United States Patent
Denaux

(10) Patent No.: US 11,846,206 B2
(45) Date of Patent: Dec. 19, 2023

(54) TURBINE VANE PROVIDED WITH A RECESS FOR EMBRITTLEMENT OF A FRANGIBLE SECTION

(71) Applicant: SAFRAN HELICOPTER ENGINES, Bordes (FR)

(72) Inventor: Matthieu Claude Jean Denaux, Bordes (FR)

(73) Assignee: SAFRAN HELICOPTER ENGINES, Bordes (FR)

( * ) Notice: Subject to any disclaimer, the term of this patent is extended or adjusted under 35 U.S.C. 154(b) by 0 days.

(21) Appl. No.: 17/614,039

(22) PCT Filed: May 18, 2020

(86) PCT No.: PCT/EP2020/063781
§ 371 (c)(1),
(2) Date: Nov. 24, 2021

(87) PCT Pub. No.: WO2020/239490
PCT Pub. Date: Dec. 3, 2020

(65) Prior Publication Data

US 2022/0235665 A1 Jul. 28, 2022

(30) Foreign Application Priority Data

May 27, 2019 (FR) ..... 1905588

(51) Int. Cl.
*F01D 5/30* (2006.01)
*F01D 21/02* (2006.01)
(Continued)

(52) U.S. Cl.
CPC ..... *F01D 5/3007* (2013.01); *F01D 21/02* (2013.01); *F01D 5/147* (2013.01); *F01D 21/045* (2013.01);
(Continued)

(58) Field of Classification Search
CPC ..... F01D 5/3007; F01D 21/02; F01D 5/147; F01D 21/045; F05D 2260/941; F05D 2270/021; F05D 2250/294
(Continued)

(56) References Cited

U.S. PATENT DOCUMENTS 5,435,694 A 7/1995 Kray et al.
2015/0176415 A1* 6/2015 Nucci ..... F01D 5/16 416/204 A
(Continued)

FOREIGN PATENT DOCUMENTS

CN 109139123 A 1/2019
FR 3067625 A1 * 6/2017

OTHER PUBLICATIONS

English machine translation of FR-3067625-A1, Nov. 29, 2022.*
(Continued)

*Primary Examiner* — Christopher Verdier
(74) *Attorney, Agent, or Firm* — Christensen O'Connor Johnson Kindness PLLC

(57) ABSTRACT

A turbine vane of a turbine engine is described. The turbine vane includes a blade and a root. The root includes a stilt having lateral flanks with a curvilinear profile. The stilt includes a frangible zone suitable for undergoing a breakage of the stilt if radial forces higher than a threshold are exerted on the vane, in particular centrifugal forces during an overspeed state of the turbine. The frangible zone includes at least one oblong frangibility recess formed on at least one of the lateral flanks of the stilt, the oblong recess extending in an axial direction of the stilt along a longitudinal axis parallel to or included in a minimum cross-sectional plane which contains a minimum cross-section of the stilt.

15 Claims, 5 Drawing Sheets

(51) Int. Cl.
*F01D 5/14* (2006.01)
*F01D 21/04* (2006.01)

(52) U.S. Cl.
CPC .. *F05D 2250/294* (2013.01); *F05D 2250/712* (2013.01); *F05D 2260/941* (2013.01); *F05D 2270/021* (2013.01)

(58) Field of Classification Search
USPC ..... 415/9; 416/2
See application file for complete search history.

(56) References Cited

U.S. PATENT DOCUMENTS

2017/0298750 A1* 10/2017 Jablonski ..... F01D 5/323
2018/0156047 A1* 6/2018 Nucci ..... F01D 5/141

OTHER PUBLICATIONS

International Search Report dated Jul. 23, 2020, issued in corresponding International Application No. PCT/EP2020/063781, filed May 18, 2020, 2 pages.

Written Opinion of the International Searching Authority dated Jul. 23, 2020, issued in corresponding International Application No. PCT/EP2020/063781, filed May 18, 2020, 5 pages.

Written Opinion of the International Searching Authority dated Jul. 23, 2020, issued in corresponding International Application No. PCT/EP2020/063781, filed May 18, 2020, 6 pages.

International Preliminary Report of Patentability dated Nov. 16, 2021, issued in corresponding International Application No. PCT/EP2020/063781, filed May 18, 2020, 1 page.

* cited by examiner

--PRIOR ART--

--PRIOR ART--

--PRIOR ART--

--PRIOR ART--

TURBINE VANE PROVIDED WITH A RECESS FOR EMBRITTLEMENT OF A FRANGIBLE SECTION

TECHNICAL FIELD

Embodiments of the present disclosure relate to turbine vanes of a turbine engine and, in particular, a turbine vane stilt arrangement. The stilt of a vane is a part supporting the vane blade which extends radially between a lower attachment part known as a "fir-tree root" and a vane platform.

More particularly, the disclosure relates to turbine vanes of a free-turbine turbine engine.

The disclosure also relates to a turbine engine comprising such vanes.

BACKGROUND

Conventionally, as illustrated in FIG. 1, a free-turbine turbine engine includes a gas generator 1, comprising at least one compressor which includes one or more compression stages 2, a combustion chamber 3, and a turbine wherein the pressurised hot gases from the combustion chamber expand and wherein the kinetic and thermal energy of the gases is converted into mechanical energy to rotate a shaft which connects the turbine to the compressor, so as to also actuate the compressor. A turbine 4, referred to as free turbine, which includes one or more turbine stages, is disposed downstream from the turbine of the gas generator 1, and mechanically uncoupled therefrom. The free turbine 4 is rotated by the gases from the gas generator 1.

In free-turbine turbine engines, used for example, but not exclusively, in helicopter propulsion units, the free turbine is mechanically independent from the helicopter rotor, a reduction gear being interposed between the shafting and the main rotor.

In the event of breakage of the power transmission line, for example in the event of breakage of the shafting or the transmission line connected to the reduction gear, the turbine can find itself in an overspeed scenario due to the disappearance of the resistive torque applied on the turbine vanes.

This overspeed scenario can be particularly hazardous, result in the breakage of at least one rotary disk supporting the vanes of a stage of the turbine, under the effect of centrifugal force, and trigger the release of very high-energy debris which cannot be contained by the armour provided on the engine.

It is therefore necessary to provide protection systems which prevent overspeed in the turbines.

In the prior art, overspeed protection systems have already been proposed, known as "blade-shedding", which involves creating a frangible zone in the vanes such that they break at a predetermined rotational speed preventing any risk of disk breakage which would be caused by the centrifugal forces. In this regard, reference can be made to GB 881,850 which describes a turbine for driving accessories wherein holes are drilled at the base of the vane blades.

Thus, in the event of overspeed risk, after the vanes break, the turbine, having lost the aerodynamic profiles thereof, slows down naturally, and can stop rotating. The deceleration of the free turbine to return to acceptable speeds prevents in this way the risk of breakage of the disk caused by centrifugal forces.

In this regard, it has been proposed to machine the leading edge of the turbine vane root in order to adjust the cross-section of the neck of the vane so that it breaks at a required speed, while retaining a sufficient contact length between the fir-tree root of the vane and the corresponding receptacle of the disk which receives the fir-tree root to ensure the mechanical strength of the attachment of the vane on the disk.

In FIGS. 2 and 3, a vane provided with a frangible section intended to break to prevent overspeed is represented.

As can be seen, the stilt 4 of the vane, which extends between the fir-tree root 6 and a platform which forms the base of an aerodynamic profile 5 or blade of the vane, includes a concave leading edge 7 for forming in the stilt a frangible zone of minimal cross-section suitable for enabling the vane to be detached from the disk from a protection threshold speed.

In FIG. 4, the radial stress which is applied in the vane stilt under the effect of thermomechanical forces is represented. As can be seen, creating a concave leading edge 7 locally reducing the cross-section of the stilt induces the appearance of a maximum stress zone Z on the leading edge, in the corners of the reduced cross-section. This increase in the maximum stress is accompanied by the appearance of an additional moment due to the misalignment of the aerodynamic profile with respect to the neck of the stilt.

It has been observed that this maximum stress determines the fatigue lifetime of the vane such that producing this concave zone in the leading edge to embrittle the vane locally requires relatively complex design work in order to define the threshold value from which the stilts break while limiting the increase in maximum stress harmful for the fatigue lifetime of the vane.

Moreover, the use of materials having an increased strength for producing the vanes induces, for the same frangible section, an increase in the threshold speed from which the stilts break.

Producing a concave zone of increased size in the leading edge of the vane so as to reduce the cross-section of the vane stilt locally would not make it possible to reduce the breakage limit speed of the stilt without increasing the maximum stress on the minimum cross-section on the stilt in a redhibitory way and hence reducing the fatigue lifetime of the vane. It is therefore desirable to be able to reduce the breakage speed of the stilt when using a high-strength material to produce the vane.

SUMMARY

In the light of the above, the disclosure aims to propose a turbine vane provided with a frangible section for setting the vane breakage speed value without increasing the maximum stress in the vane.

Therefore, the disclosure relates to a turbine vane comprising a blade and a root, the root comprising a stilt having lateral flanks with a curvilinear profile, the stilt comprising a frangible zone adapted to undergo a breakage of the stilt if radial forces greater than a threshold are exerted on the vane, in particular centrifugal forces during an overspeed state of the turbine.

The frangible zone comprises at least one oblong frangibility recess formed on at least one of the lateral flanks of the stilt, the oblong recess extending in an axial direction of the stilt along a longitudinal axis parallel to or comprised in a minimum cross-sectional plane in which a minimum cross-section of the stilt is located.

This recess thus helps embrittle the frangible section of the stilt by increasing the mean stress exerted in the neck of the stilt, without significantly increasing the maximum stress induced locally under the action of thermomechanical forces. It hence helps optimise the setting of the limit speed from which the vanes break.

Advantageously, the vane is mounted on a disk, the longitudinal axis of the or each oblong recess being comprised in a frangibility plane located at a distance from an axis of rotation of the disk between h+0.06h and h−0.06h, preferably between h+0.04h and h−0.04h, h being the distance between the axis of rotation and the minimum cross-sectional plane, the frangibility plane and the minimum cross-sectional plane being parallel to one another and to the axis of rotation.

According to another feature, the frangible zone of the stilt is formed by a concave zone of the stilt formed on a front face and on at least one of the lateral flanks of the stilt, the deepest zone of the oblong recess being intersected by the minimum cross-sectional plane of the stilt.

For example, the maximum depth of the oblong recess is between 9% and 35% of the width of the stilt, preferably between 10% and 25% of the width of the stilt, considered at the deepest point of the recess.

In one embodiment, the maximum depth of the oblong recess is between 10% and 25% of the length thereof, preferably between 14% and 20% of the length of the recess.

In one embodiment, wherein each lateral flank of the stilt comprises an oblong frangibility recess, the distance between the barycentre of the recesses and the projection of the centre of gravity of the vane on the minimum cross-sectional plane is between 0 and 20% of the axial length of the stilt, preferably between 0 and 15% of the width of the stilt.

Advantageously, the oblong recess has a curvilinear cross-section.

Preferably, the oblong recess has a cross-section in the arc of a circle.

The disclosure also relates to a turbine engine turbine, comprising a rotor including at least one disk and a set of turbine vanes mounted on the disk, each vane being a vane as defined above.

Advantageously, the longitudinal axis of the or each oblong recess of each vane is comprised in a frangibility plane located at a distance from an axis of rotation of the disk between h+0.06h and h−0.06h, preferably between h+0.04h and h−0.04h, h being the distance between the axis of rotation of the disk and the minimum cross-sectional plane, the frangibility plane and the minimum cross-sectional plane being parallel to one another and to the axis of rotation.

Further aims, features and advantages of the disclosure will emerge on reading the following description, given merely by way of example, with reference to the appended drawings.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth below in connection with the appended drawings, where like numerals reference like elements, is intended as a description of various embodiments of the disclosed subject matter.

Figure 1:
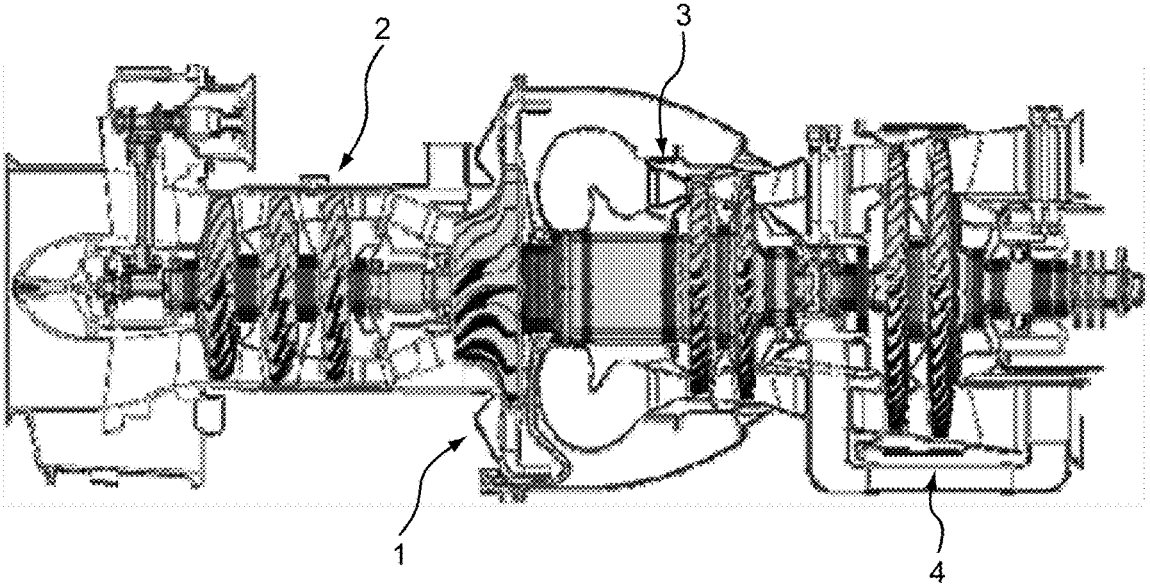
FIG. 1 illustrates the general structure of a free-turbine gas turbine according to the FIG. 2 is a front view of a vane according to the prior art.
Figure 2:
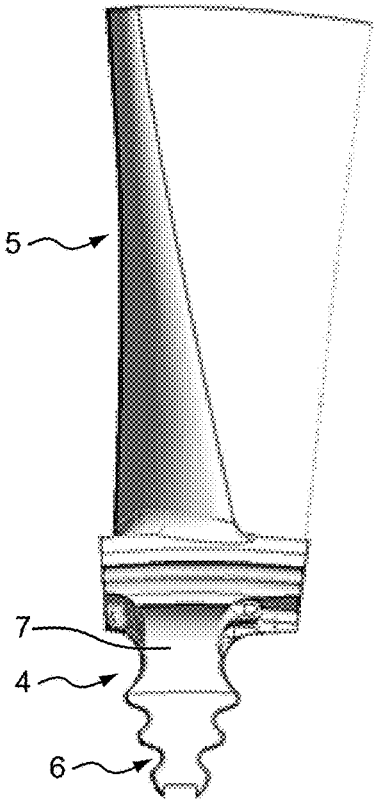
Figure 3:
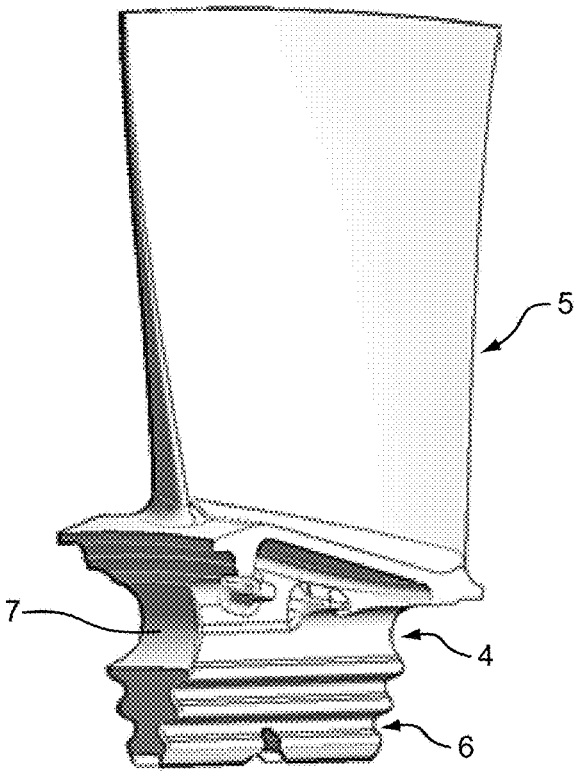
FIG. 3 is a perspective view of a vane according to the prior art.
Figure 4:
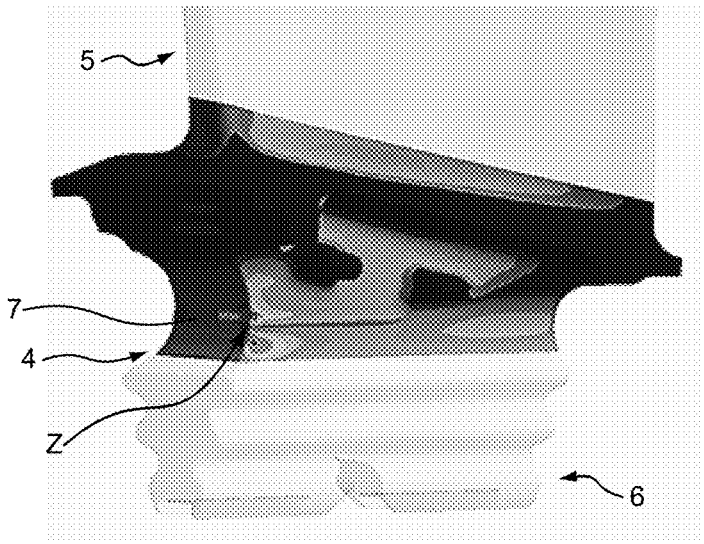
FIG. 4 shows the stress field exerted on the stilt of the vane in FIGS. 2 and 3.
Figure 5:
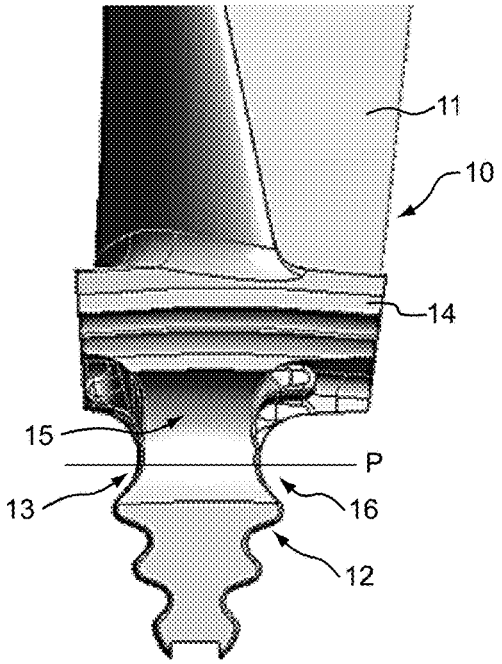
FIG. 5 is a front view of a vane according to the disclosure.
Figure 6:
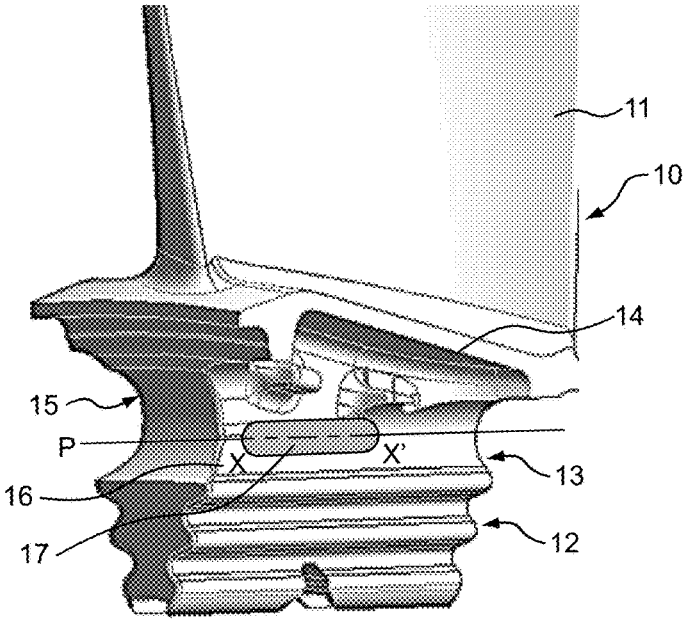
FIG. 6 is a perspective view of a vane according to the disclosure.

In FIGS. 5 and 6, a turbine engine vane, in particular a free turbine vane, represented by the general reference number 10, according to an embodiment of the disclosure is shown.

This vane 10 includes a blade 11, a fir-tree root 12 intended to fasten the vane onto a rotor risk, by engaging the root 12 into a housing also known as "receptacle" of corresponding shape formed in the disk, a stilt 13 extending the fir-tree root 12 and a platform 14.

The fir-tree root extends along a longitudinal axis, which in a manner known per se can form an angle with the axis of rotation A-A' of the turbine disk, in order to increase the contact length between the fir-tree root and the disk. The axis of the fir-tree root once the vane is mounted on the disk extends along the direction of the corresponding receptacle in the disk. The receptacles of a free turbine disk can be provided each more or less sloping in a tangential plane to the disk, with respect to the axial direction of the disk. In other words, an angle in a tangential plane to the disk is formed between the direction of a receptacle and the axis of the disk.

As can be seen, the stilt 13 has a curvilinear shape.

It includes, on the anterior face thereof, on the side of the leading edge of the vane, a concave shape 15 and lateral flanks 16, also concave, in order to reduce the cross-section of the stilt locally to delimit a frangible zone in the stilt.

The vane 10 also includes recesses 17 that are oblong, i.e. having a longitudinal dimension greater than the lateral dimension thereof, which are formed in the lateral flanks of the stilt 13. Each recess 17 extends along a longitudinal axis X-X' parallel or substantially parallel to the fir-tree root. The axis X-X' of each recess can, therefore, like the axis of the fir-tree root, form an angle with the axis of rotation A-A' of the turbine disk, seen in FIG. 9.

Each recess forms a pocket locally reducing the cross-section of the neck of the stilt in order to embrittle the frangible zone of the stilt and set the overspeed limit speed from which the blade is detached from the disk.

For example, as illustrated, each lateral flank of the stilt includes at least one recess. Each lateral flank includes here a recess, the stilt comprising a pair of recesses formed symmetrically.

Figure 7:
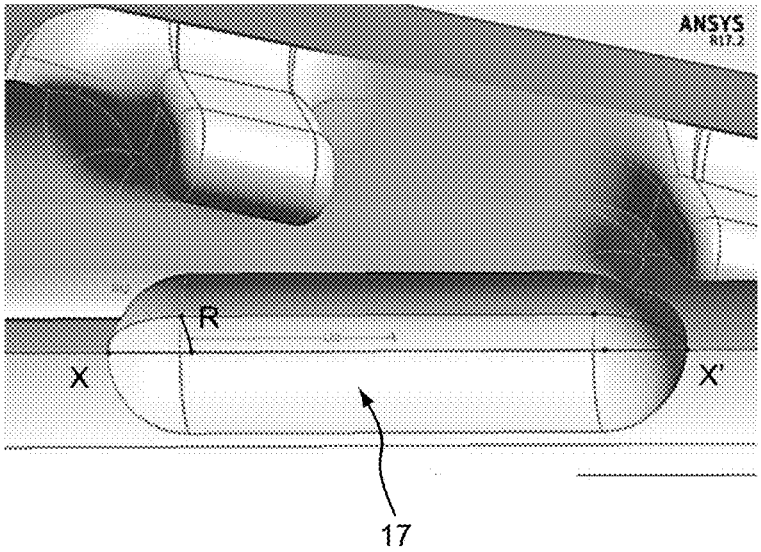
FIG. 7 is a detailed view on a larger scale of the vane of FIG. 6.

As illustrated in FIG. 7, each recess includes a concave cross-section, considered perpendicular to the longitudinal axis of the cavity, preferably a round cross-section, with no edges. The radius R of the recess is preferably between 10 and 25% of the length of the recess, advantageously between 14% and 20% of the length of the recess.

Figure 8:
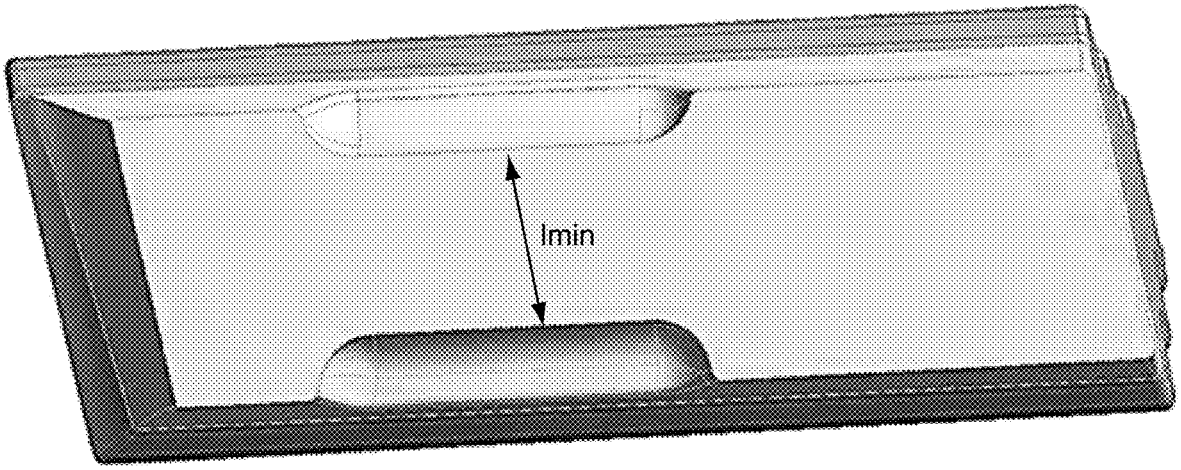
FIG. 8 is a cross-sectional view of the stilt of the vane of FIGS. 5 and 6 at the deepest point of the recesses.

The depth thereof, which can for example correspond to the radius of the recess, is advantageously between 9% and 35% of the minimum width lmin of the stilt, considered at the deepest point of the recess (FIG. 8). The depth of the recess is preferably between 10% and 25% of the width lmin of the stilt.

Figure 9:
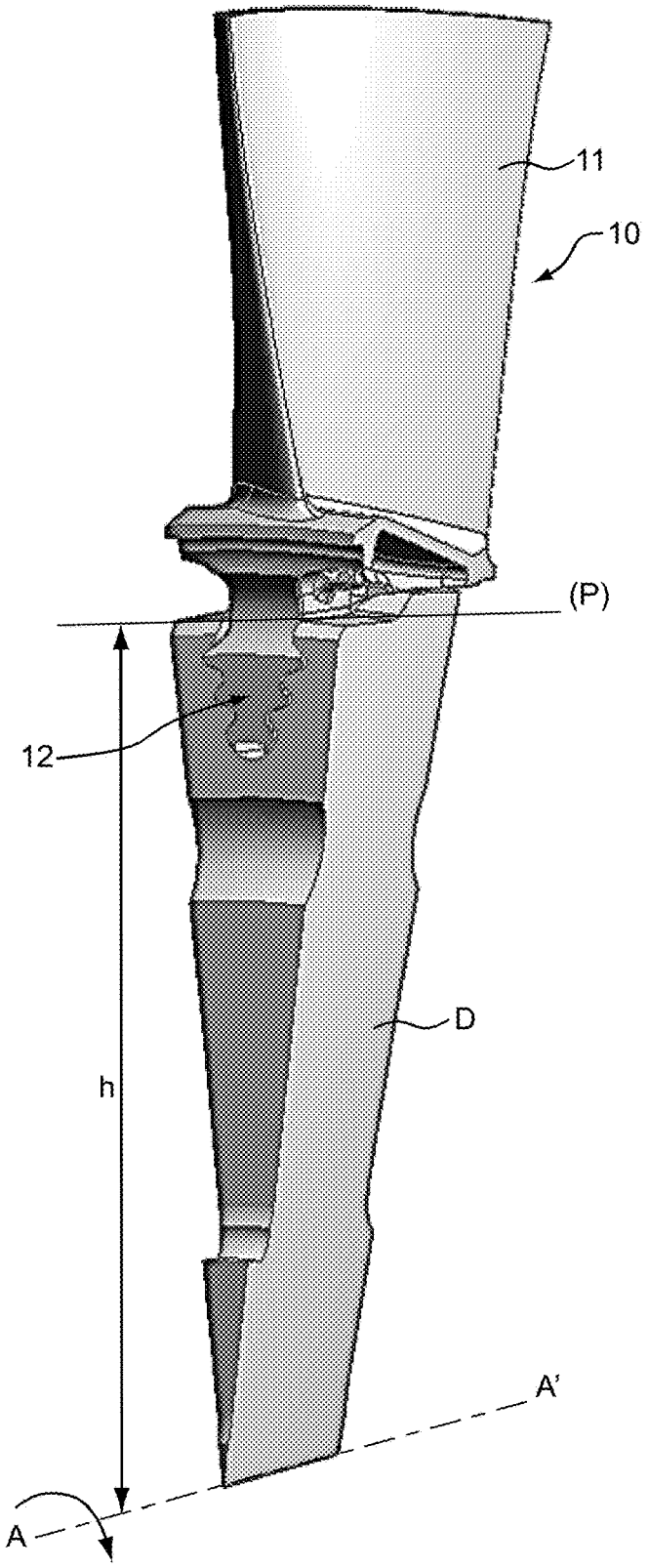
FIG. 9 shows the vane of FIGS. 5 and 6 mounted on a rotor disk.

With reference to FIG. 9, which illustrates a vane mounted on a portion of a disk D, each recess is formed in the concave surface of a lateral flank of the stilt and extends parallel to a longitudinal plane P which coincides with the minimum width of the neck of the stilt.

Considering the distance h between the axis of rotation A-A' of the turbine disk and the plane P, the axis X-X' of each recess is comprised in a plane, hereinafter referred to as frangibility plane, which either coincides with the plane P, or is parallel to the plane P and is located slightly above or above the plane P. More specifically, the frangibility plane is located at a distance from the axis of rotation A-A' of the disk between h−0.06h and h+0.06h, preferably between h−0.04h and h+0.04h. Moreover, if the stilt comprises a pair of recesses formed symmetrically, the frangibility plane comprises the two respective axes X-X' of the two recesses.

Figure 10:
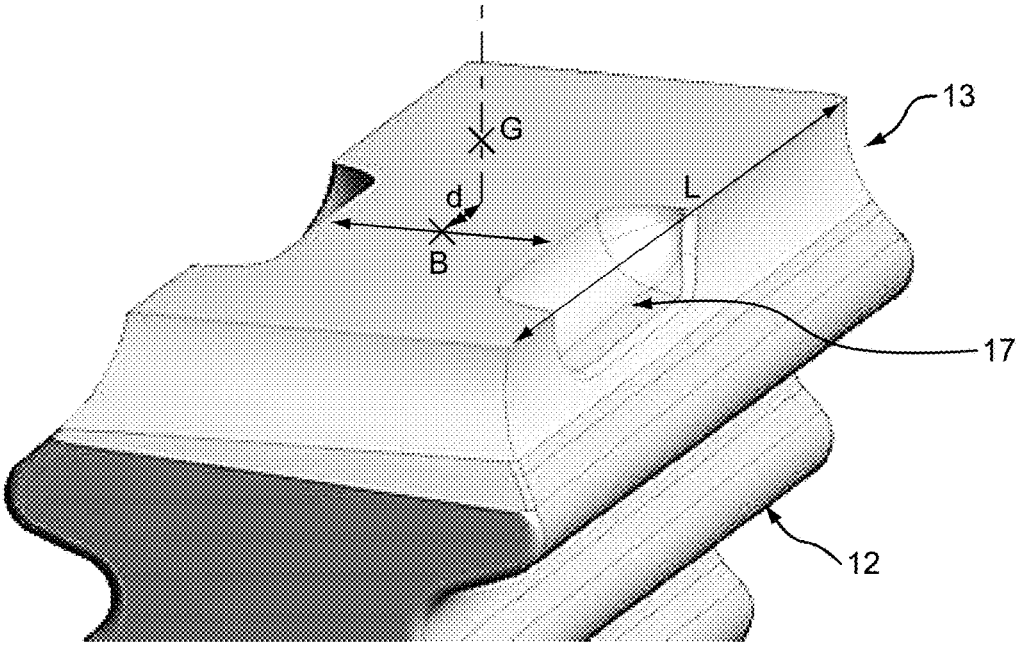
FIG. 10 is a perspective view of FIG. 8.

Moreover, as seen in FIG. 10, which illustrates a perspective and cross-sectional view at the deepest points of the recesses, the distance d between the barycentre B of all the recesses and the radial projection of the centre of gravity G of the vane on the cross-section is between 0 and 20% of the axial length L of the stilt at the point of the minimum cross-section thereof, preferably between 0 and 15% of this length L. The axial length L is measured along a direction parallel to the axis of the fir-tree root, which can advantageously form an angle with the axis of rotation A-A' of the turbine disk. This angle is for example between 5° and 20°.

The length of the recesses is for example about 40% of the total length of the fir-tree root at the point of the minimum cross-section and the depth thereof is about 20% of the neck width.

Each lateral flank of the stilt can include any number of recesses in order to reduce the cross-section of the stilt locally and as such set the limit rotational speed of the vanes.

As stated above, the recesses are free from sharp angles so as not to induce concentration of higher stress than that already induced by the concave shape formed in the anterior face, on the leading edge side.

These recesses make it possible to set the breakage speed of the vane by increasing the mean stress exerted in the neck of the stilt, without significantly increasing the maximum stress induced under the action of thermomechanical forces harmful for the lifetime of the vane.

Figure 11:
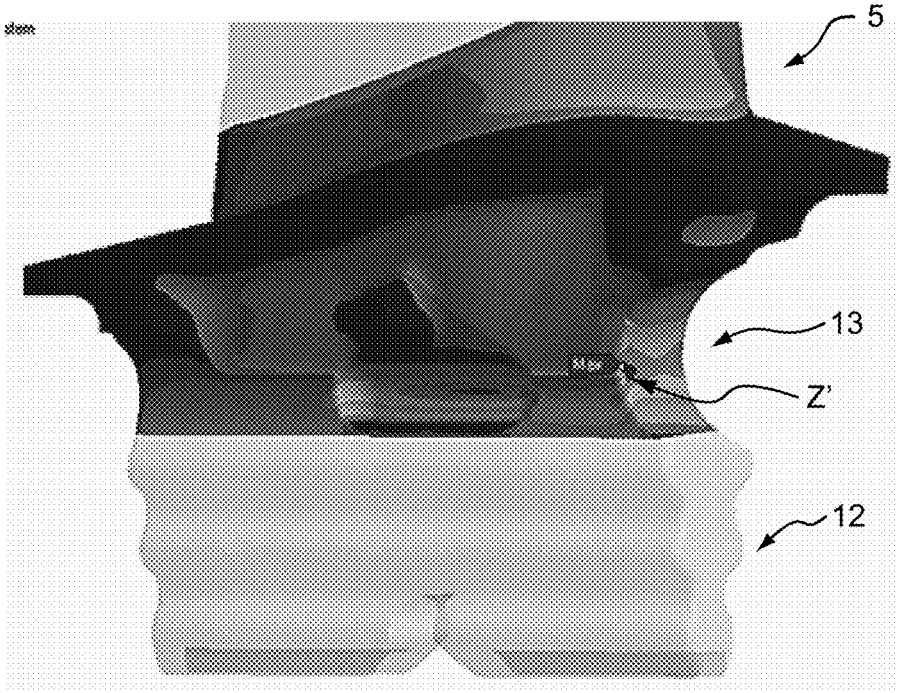
FIG. 11 shows the stress field exerted on the stilt of the vane of FIGS. 5 and 6.

Indeed, as shown in FIG. 11, which illustrates the radial stress field exerted in the vane under the action of thermomechanical forces, introducing a recess into the frangible zone of the stilt does not induce a significant increase in the maximum stress which remains localised in the zone Z' of the edge of the concavity of the leading edge of the vane. For example, introducing an oblong recess into each of the two lateral flanks of the stilt, in the case represented in FIG. 11, increased the maximum stress locally by merely 1%.

The principles, representative embodiments, and modes of operation of the present disclosure have been described in the foregoing description.

The invention claimed is:

1. A turbine vane of a turbine engine, including a blade and a root, said root comprising a stilt having lateral flanks with a curvilinear profile, said stilt comprising a frangible zone adapted to undergo a breakage of the stilt if radial forces greater than a threshold are exerted on the vane, wherein the frangible zone comprises at least one oblong frangibility recess formed on at least one of the lateral flanks of the stilt, said at least one oblong recess extending in an axial direction of the stilt along a longitudinal axis parallel to or comprised in a minimum cross-sectional plane in which a minimum cross-section of the stilt is located, the frangible zone of the stilt being formed by a concave zone of the stilt formed on a front face and on at least one of the lateral flanks of the stilt, the deepest zone of said at least one oblong recess being intersected by the minimum cross-sectional plane of the stilt, wherein the turbine vane is mounted on a turbine engine rotor disk, and wherein the longitudinal axis of the at least one oblong recess is comprised in a frangibility plane located at a distance from an axis of rotation of the disk comprised between h+0.06h and h−0.06h, h being the distance between the axis of rotation and the minimum cross-sectional plane, the frangibility plane and the minimum cross-sectional plane being parallel to one another and to the axis of rotation.

2. The turbine vane according to claim 1, wherein the maximum depth of said at least one oblong recess is between 9% and 35% of the width of the stilt, considered at the deepest point of the at least one oblong recess.

3. The turbine vane according to claim 2, wherein the maximum depth of said at least one oblong recess is between 10% and 25% of the width of the stilt.

4. The turbine vane according to claim 1, wherein the maximum depth of said at least one oblong recess is between 10% and 25% of the length thereof.

5. The turbine vane according to claim 4, wherein the maximum depth of said at least one oblong recess is between 14% and 20% of the length thereof.

6. The turbine vane according to claim 1, wherein each lateral flank of the stilt comprises an oblong frangibility recess and wherein the distance between the barycentre of the recesses and the projection of the centre of gravity of the vane on the minimum cross-sectional plane is between 0 and 20% of the axial length of the stilt.

7. The turbine vane according to claim 6, wherein the distance between the barycentre of the recesses and the projection of the centre of gravity of the vane on the minimum cross-sectional plane is between 0 and 15% of the axial length of the stilt.

8. The turbine vane according to claim 1, wherein said at least one oblong recess has a curvilinear cross-section.

9. The turbine vane according to claim 1, wherein said at least one oblong recess has a cross-section in the arc of a circle.

10. A turbine engine turbine, comprising a rotor including at least one disk and a set of turbine vanes mounted on the disk, wherein each vane of the set of turbine vanes is a turbine vane according to claim 1.

11. The turbine engine turbine according to claim 10, wherein said distance from the axis of rotation of the disk is between h+0.04h and h−0.04h.

12. The turbine vane according to claim 1, wherein said radial forces greater than a threshold are centrifugal forces exerted on the vane during an overspeed state of the turbine engine.

13. The turbine vane according to claim 1, wherein said distance from the axis of rotation of the disk is between h+0.04h and h−0.04h.

14. A turbine vane of a turbine engine, including a blade and a root, said root comprising a stilt having lateral flanks with a curvilinear profile, said stilt comprising a frangible zone adapted to undergo a breakage of the stilt if radial forces greater than a threshold are exerted on the vane wherein the frangible zone comprises at least one oblong frangibility recess formed on at least one of the lateral flanks of the stilt, said at least one oblong recess extending in an axial direction of the stilt along a longitudinal axis parallel to or comprised in a minimum cross-sectional plane in which a minimum cross-section of the stilt is located, the frangible zone of the stilt being formed by a concave zone of the stilt formed on a front face and on at least one of the lateral flanks of the stilt, the deepest zone of said at least one oblong recess being intersected by the minimum cross-sectional plane of the stilt, wherein the maximum depth of said at least one oblong recess is between 10% and 25% of the length thereof.

15. A turbine vane of a turbine engine, including a blade and a root, said root comprising a stilt having lateral flanks with a curvilinear profile, said stilt comprising a frangible zone adapted to undergo a breakage of the stilt if radial forces greater than a threshold are exerted on the vane wherein the frangible zone comprises at least one oblong frangibility recess formed on at least one of the lateral flanks of the stilt, said at least one oblong recess extending in an axial direction of the stilt along a longitudinal axis parallel to or comprised in a minimum cross-sectional plane in which a minimum cross-section of the stilt is located, the frangible zone of the stilt being formed by a concave zone of the stilt formed on a front face and on at least one of the lateral flanks of the stilt, the deepest zone of said at least one oblong recess being intersected by the minimum cross-sectional plane of the stilt, wherein each lateral flank of the stilt comprises an oblong frangibility recess and wherein the distance between the barycentre of the recesses and the projection of the centre of gravity of the vane on the minimum cross-sectional plane is between 0 and 20% of the axial length of the stilt.

* * * * *